US008916321B2

(12) United States Patent
Kawakami et al.

(10) Patent No.: US 8,916,321 B2
(45) Date of Patent: Dec. 23, 2014

(54) ELECTROSTATIC CHARGE IMAGE DEVELOPING TONER, ELECTROSTATIC CHARGE IMAGE DEVELOPER, TONER CARTRIDGE, PROCESS CARTRIDGE, AND IMAGE FORMING APPARATUS

(71) Applicant: Fuji Xerox Co., Ltd., Tokyo (JP)

(72) Inventors: Eiji Kawakami, Kanagawa (JP); Tetsuya Taguchi, Kanagawa (JP); Hirokazu Hamano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/965,539

(22) Filed: Aug. 13, 2013

(65) Prior Publication Data

US 2014/0287352 A1 Sep. 25, 2014

(30) Foreign Application Priority Data

Mar. 21, 2013 (JP) ..... 2013-058903

(51) Int. Cl.

| | |
|---|---|
| ***G03G 9/08*** | (2006.01) |
| ***G03G 9/107*** | (2006.01) |
| ***G03G 15/08*** | (2006.01) |
| ***G03G 9/097*** | (2006.01) |

(52) U.S. Cl.

CPC ..... *G03G 9/107* (2013.01); *G03G 15/0865* (2013.01); *G03G 9/09708* (2013.01); *G03G 2215/0132* (2013.01)

USPC ..... 430/108.6; 399/252

(58) Field of Classification Search

CPC ..... G03G 9/09708

USPC ..... 430/108.6; 399/252

See application file for complete search history.

(56) References Cited

U.S. PATENT DOCUMENTS

2009/0142684 A1 6/2009 Anno et al.

FOREIGN PATENT DOCUMENTS

| | | |
|---|---|---|
| JP | A-2009-63616 | 3/2009 |
| JP | A-2009-134073 | 6/2009 |
| JP | A-2010-19887 | 1/2010 |
| JP | B2-4853465 | 1/2012 |
| JP | B2-4979517 | 7/2012 |

*Primary Examiner* — Mark A Chapman

(74) *Attorney, Agent, or Firm* — Oliff PLC

(57) ABSTRACT

An electrostatic charge image developing toner includes toner particles, and an external additive containing titanate compound particles having an iron content of from greater than 1200 ppm to 6000 ppm.

20 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2013-058903 filed Mar. 21, 2013.

BACKGROUND

1. Technical Field

The present invention relates to an electrostatic charge image developing toner, an electrostatic charge image developer, a toner cartridge, a process cartridge, and an image forming apparatus.

2. Related Art

Currently, various fields use a method of visualizing image information through an electrostatic charge image using electrophotography or the like. In electrophotography, image information is formed as an electrostatic charge image on a surface of an image holding member (photoreceptor) through charging and exposure steps, a toner image is developed on the surface of the photoreceptor using a developer containing a toner, and this toner image is subjected to a transfer step of transferring onto a recording medium such as paper and a fixing step of fixing the toner image onto a surface of the recording medium to be visualized as an image.

SUMMARY

According to an aspect of the invention, there is provided an electrostatic charge image developing toner including: toner particles; and an external additive containing titanate compound particles having an iron content of from greater than 1200 ppm to 6000 ppm.

BRIEF DESCRIPTION OF THE DRAWINGS

Exemplary embodiments of the present invention will be described in detail based on the following figures, wherein.

DETAILED DESCRIPTION

Figure 1:
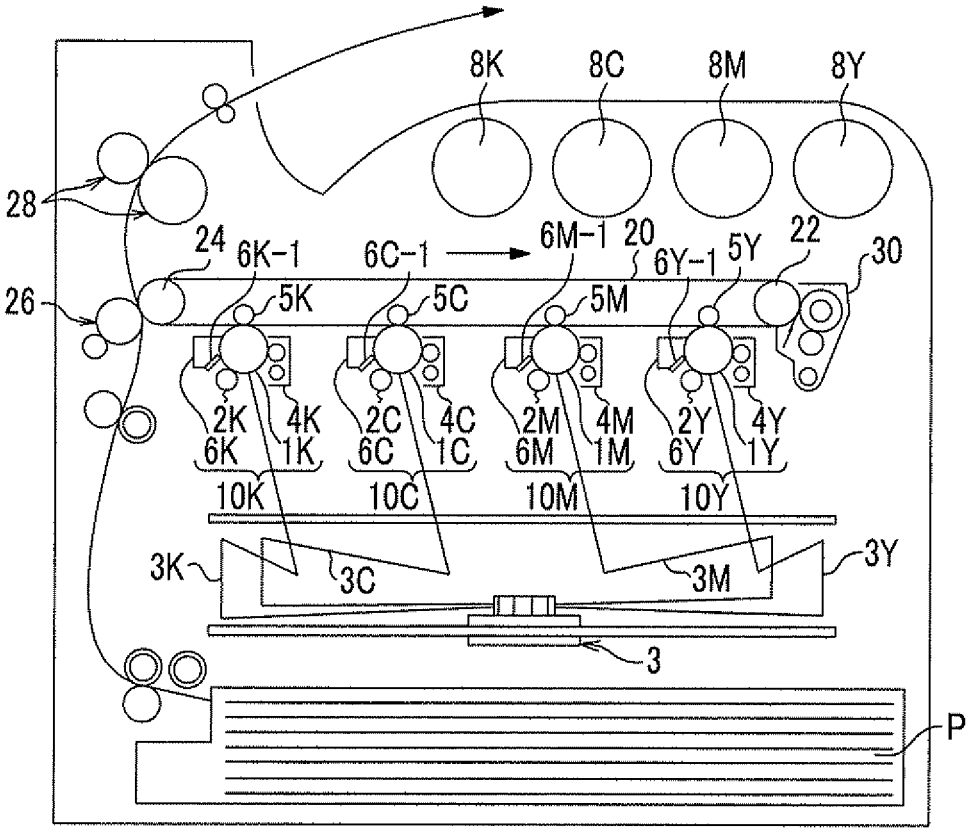
FIG. 1 is a schematic diagram showing a configuration of an example of an image forming apparatus according to an exemplary embodiment.

Hereinafter, exemplary embodiments of the invention will be described in detail.

Transparent Electrostatic Charge Image Developing Toner

An electrostatic charge image developing toner (hereinafter, referred to as "toner") according to an exemplary embodiment has toner particles and an external additive containing titanate compound particles.

As the titanate compound particles, titanate compound particles having an iron content of greater than 1200 ppm to 6000 ppm are applied.

Here, it has been known that among external additives of a toner, titanate compound particles are used as an abrasive.

However, when a toner containing titanate compound particles as an external additive is used to continuously output images in which an image part and a non-image part are clearly separated under a low-temperature and low-humidity environment (for example, 10° C., 15% RH) and then to output halftone images, unevenness may occur on the images. Specifically, for example, in a non-image part of an image that is previously output, dot disarrangement and a reduction in image density may occur in a halftone image to be output later.

The image in which an image part and a non-image part are clearly separated is, for example, an image including an image part (for example, solid image) having an image density of 90% or greater and a non-image part, in which a boundary between the image part and the non-image part may be visually confirmed. The halftone image is, for example, an image having an image density of from 40% to 60%.

The mechanism why the image unevenness occurs is not clear. However, it is presumed, as described below, it is because there is a difference in the behavior of the titanate compound particles between the image part and the non-image part.

First, when images in which an image part and a non-image part are clearly separated are continuously output under a low-temperature and low-humidity environment, it is thought that a phenomenon in which titanate compound particles liberated from the toner are developed on a non-image part of an image holding member occurs in the non-image part. It is thought that the reason for this is that a charge amount of the titanate compound particles alone is small.

Here, since the titanate compound particles have a perovskite crystal structure, the titanate compound particles exhibit behavior (behavior in which dielectric polarization is caused by an electric field and the polarization remains even when the electric field application is stopped) of a ferroelectric substance or behavior equivalent thereto. Thus, it is thought that under a low-temperature and low-humidity environment, a negative charge region and a positive charge region are locally generated prominently due to the dielectric polarization by developing bias in the titanate compound particles. Particularly, since the amount of moisture is small at low temperature and low humidity and thus the permittivity increases, it is thought that an electrostatic adhesion force acts between the negative charge region in the titanate compound particles and the positive charge region on the image holding member.

Therefore, the titanate compound particles adhering to the non-image part of the image holding member are not easily removed by a cleaning blade due to the electrostatic adhesion force that is strong with respect to the image holding member, and contaminate a contact charging-type charging unit (for example, charging roll), and it is thought that due to this contamination, the surface resistance of the charging unit changes.

Meanwhile, in the image part, it is thought that the titanate compound particles externally added to the toner are developed on the image part of the image holding member. It is thought that the titanate compound particles externally added to the toner are also dielectrically polarized by developing bias, and it is thought that a part of the titanate compound externally added to the toner is separated from the toner by a stress of a nip part of the cleaning blade, and adheres to the positive charge region of the image holding member since a strong electrostatic adhesion force acts. However, in the image part, a toner dam is formed on the cleaning blade, and thus it is thought that a most part of the separated titanate compound particles is easily removed by the cleaning blade.

Therefore, it is thought that the contact charging-type charging unit (for example, charging roll) is not easily contaminated and a change in surface resistance of the charging unit by contamination does not easily occur.

It is thought that due to the difference in the behavior of the titanate compound particles between the non-image part and the image part, a difference in the surface resistance of the contact charging-type charging unit is generated between the non-image part and the image part, and a difference in the charging performance of the charging unit is also generated. As a result, it is thought that when a halftone image is output after continuous output of images in which an image part and a non-image part are clearly separated under a low-temperature and low-humidity environment, image unevenness occurs.

On the other hand, in the case of titanate compound particles having an iron content of greater than 1200 ppm to 6000 ppm, its perovskite crystal structure is appropriately disturbed by iron atoms contained, and thus it is thought that remaining of the dielectric polarization is relieved. Therefore, it is thought that when these titanate compound particles are applied, the electrostatic adhesion force of the titanate compound particles with respect to the image holding member is weak. As a result, it is thought that even the titanate compound particles adhering to the non-image part of the image holding member are easily removed by the cleaning blade, and thus a change in surface resistance of the charging unit by contamination is suppressed.

Accordingly, in the case of the toner according to this exemplary embodiment, image unevenness occurring in a halftone image that is output after continuous output of images in which an image part and a non-image part are clearly separated under a low-temperature and low-humidity environment is suppressed by applying titanate compound particles having an iron content of from greater than 1200 ppm to 6000 ppm.

Hereinafter, a configuration of the toner according to this exemplary embodiment will be described in detail.

Toner Particles

The toner particles are configured to include, for example, a binder resin, and if necessary, a colorant, a release agent, and other additives.

Binder Resin

Examples of the binder resin include vinyl resins formed of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene and butadiene), or copolymers obtained by combining two or more kinds of these monomers.

As the binder resin, there are also exemplified non-vinyl resins such as epoxy resins, polyester resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins.

These binder resins may be used singly or in combination of two or more kinds thereof.

A polyester resin is suitable as the binder resin.

A condensation polymer of a polyvalent carboxylic acid and a polyol is exemplified as the polyester resin. A commercially available product or a synthesized product may be used as an amorphous polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, and lower alkyl esters (having, for example, from 1 to 5 carbon atoms) thereof. Among these, for example, aromatic dicarboxylic acids are preferable as the polyvalent carboxylic acid.

The polyvalent carboxylic acid may be used in combination with a tri- or higher-valent carboxylic acid employing a crosslinked structure or a branched structure, together with a dicarboxylic acid. Examples of the tri- or higher-valent carboxylic acid include trimellitic acid, pyromellitic acid, anhydrides thereof, and lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic dials (e.g., ethylene oxide adduct of bisphenol A and propylene oxide adduct of bisphenol A). Among these, for example, aromatic diols and alicyclic diols are preferable, and aromatic dials are more preferable as the polyol.

The polyol may be used in combination with a tri- or higher-valent polyol employing a crosslinked structure or a branched structure, together with dial. Examples of the tri- or higher-valent polyol include glycerin, trimethylolpropane, and pentaerythritol.

The polyols may be used singly or in combination of two or more kinds thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from the "extrapolated glass transition onset temperature" described in the method of obtaining a glass transition temperature in the "testing methods for transition temperatures of plastics" in JIS K-1987.

The weight average molecular weight (Mw) of the polyester resin is preferably from 5000 to 1000000, and more preferably from 7000 to 500000.

The number average molecular weight (Mn) of the polyester resin is preferably from 2000 to 100000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed using GPC manufactured by Tosoh Corporation HLC-8120 as a measuring device, column manufactured by Tosoh Corporation TSK gel Super HM-M (15 cm), and a THF solvent. The weight average molecular weight and the number average molecular weight are calculated using a molecular weight calibration curve plotted from a monodisperse polystyrene standard sample from the results of the above measurement.

A known manufacturing method is used to manufacture the polyester resin. Specific examples thereof include a method of conducting a reaction at a polymerization temperature set to from 180° C. to 230° C., if necessary, under reduced pressure in the reaction system, while removing water or an alcohol that is generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be preliminarily condensed and then polycondensed with the major component.

The content of the binder resin is, for example, preferably from 40% by weight to 95% by weight, more preferably from 50% by weight to 90% by weight, and even more preferably from 60% by weight to 85% by weight with respect to the entire toner particles.

Colorant

Examples of the colorant include various pigments such as carbon black, chrome yellow, Hansa yellow, benzidine yellow, thuren yellow, quinoline yellow, pigment yellow, permanent orange GTR, pyrazolone orange, Balkan orange, watch young red, permanent red, brilliant carmin 3B, brilliant carmin 6B, DuPont oil red, pyrazolone red, lithol red, Rhodamine B Lake, Lake Red C, pigment red, rose bengal, aniline blue, ultramarine blue, chalco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more kinds thereof.

If necessary, the colorant may be surface-treated or used in combination with a dispersant. Plural kinds of colorants may be used in combination.

The content of the colorant is, for example, preferably from 1% by weight to 30% by weight, and more preferably from 3% by weight to 15% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from the "melting peak temperature" described in the method of obtaining a melting temperature in the "testing methods for transition temperatures of plastics" in JIS K-1987, from a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles include these additives as internal additives.

Characteristics of Toner Particles

The toner particles may have a single-layer structure, or a so-called core-shell structure composed of a core (core particle) and a coating layer (shell layer) that is coated on the core.

Here, toner particles having a core-shell structure may preferably be composed of, for example, a core configured to include a binder resin, and if necessary, other additives such as a colorant and a release agent, and a coating layer configured to include a binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) with ISOTON-II (manufactured by Beckman Coulter, Inc.) as an electrolyte.

In the measurement, from 0.5 mg to 50 mg of a measurement sample is added to 2 ml of an aqueous solution of 5% surfactant (preferably sodium alkylbenzene sulfonate) as a dispersant. The obtained material is added to from 100 ml to 150 ml of an electrolyte.

The electrolyte in which the sample is suspended is subjected to a dispersion treatment using an ultrasonic disperser for 1 minute, and a particle size distribution of particles having a particle diameter of from 2 μm to 60 μm is measured by a Coulter Multisizer II using an aperture having an aperture diameter of 100 μm. 50000 particles are sampled.

Cumulative distributions by volume and by number are drawn from the side of the smallest diameter on the basis of particle size ranges (channels) separated based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a cumulative number average particle diameter D50p. Furthermore, the particle diameter when the cumulative percentage becomes 84% is defined as that corresponding to a volume particle diameter D84v and a number particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

A shape factor SF1 of the toner particles is preferably from 110 to 150, and more preferably from 120 to 140.

The shape factor SF1 is obtained through the following expression.

$$SF1=(ML^2/A)\times(\pi/4)\times 100 \qquad \text{Expression:}$$

In the above expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles applied to a surface of a glass slide is input to an image analyzer Luzex through a video camera to obtain maximum lengths and projected areas of 100 particles, values of SF1 are calculated using the above expression, and an average value thereof is obtained.

External Additive

Titanate compound particles are included as an external additive. Other than the titanate compound particles, other external additives may be included.

Titanate Compound Particles

The titanate compound particles include iron (iron atoms) at greater than 1200 ppm to 6000 ppm (preferably from 1240 ppm to 5000 ppm, and more preferably from 1250 ppm to 4000 ppm).

When the iron (iron atoms) content is greater than 1200 ppm, the perovskite crystal structure of the titanate compound particles is appropriately disturbed, and as a result, occurrence of image unevenness is suppressed.

When the iron (iron atoms) content is 6000 ppm or less, formation of a communication path of iron (iron atoms) by excessive disturbance of the perovskite crystal structure of the titanate compound particles is suppressed. As a result, unstabilization in charging of the toner that is developed in the image part is suppressed, and thus occurrence of image unevenness is suppressed.

The iron (iron atoms) content is a content of iron (iron atoms) that is included per unit mass of the titanate compound.

The iron content is adjusted by, for example, the amount of an iron compound (e.g., iron chloride, iron sulfide, and iron oxide) to be added when the titanate compound particles are manufactured.

It is thought that the iron is included in the titanate compound particles in the form of an iron compound (e.g., iron sesquioxide) or in the form of being incorporated in the crystal lattice of the titanate compound.

The iron (iron atoms) content in the titanate compound particles is measured using an inductively coupled plasma optical emission spectrometer (ICP-OES).

The measurement procedures are as follows.

1. 1 g of titanate compound particles as a measurement object are put into a dried 200 mL beaker.

2. 20 mL of a sulfuric acid is added to the beaker to perform a treatment by using a sealing-type microwave wet-decomposition device "MLS-1200 MEGA" (manufactured by MILESTONE Inc.) until there is no undissolved matter. Then, the obtained material is water-cooled to obtain a solution.

3. The treated solution is transmitted to a 100 mL measuring flask and distilled water is added thereto to adjust a sample solution having a total volume of 100 mL.

4. The sample solution is further four-fold diluted with distilled water to obtain an analysis sample.

5. Using the analysis sample, the measurement is performed by the use of ICP-OES at a Fe wavelength of 238.204 nm, and the measurement result is checked against a calibration curve corresponding to the composition of the analysis sample to weigh iron ions.

A sample for preparing a calibration curve is adjusted by preparing an analysis sample of a titanate compound containing no iron and by adding an iron standard solution.

The titanate compound constituting the titanate compound particles is referred to as metatitanate, and is, for example, salt that is formed from titanium oxide and other metal oxides or other metal carbonates.

Specific examples of the titanate compound particles include strontium titanate ($SrTiO_3$) particles, calcium titanate ($CaTiO_3$) particles, magnesium titanate ($MgTiO_3$) particles, barium titanate ($BaTiO_3$) particles, and zinc titanate ($ZnTiO_3$) particles. These titanate compound particles may be used singly or in combination of two or more kinds thereof.

Among these, strontium titanate particles, calcium titanate particles, and magnesium titanate particles are preferable as the titanate compound particles.

Particularly, strontium titanate particles tend to have weaker ferroelectricity than other titanate compound particles. Accordingly, strontium titanate particles are suitable in view of the fact that the perovskite crystal structure is appropriately disturbed by adjusting the iron content.

The volume average particle diameter of the titanate compound particles is not particularly limited, and may be, for example, from 0.1 μm to 3.0 μm, preferably from 0.3 μm to 2.0 μm.

Here, the volume average particle diameter of the titanate compound particles is measured as follows. 100 primary particles of titanate compound particles after external addition of the titanate compound particles to toner particles are observed using a scanning electron microscope (SEM) device, the longest diameter and the shortest diameter of the particle are measured by image analysis of the primary particles, and a sphere-equivalent diameter is measured from an intermediate value between the longest diameter and the shortest diameter. A 50% diameter (D50v) in the cumulative frequency of the obtained sphere-equivalent diameter is set as an average particle diameter (that is, volume average particle diameter) of the titanate compound particles.

The titanate compound particles are prepared by a known method such as a solid-phase method or a liquid-phase method.

The solid-phase method is, for example, a method in which titanium oxide and other metal oxides or other metal carbonates are mixed and baked.

The liquid-phase method is, for example, a method in which a metatitanic acid (hydrate of titanium oxide) and other metal oxides or other metal carbonates are reacted in an aqueous medium and then baked.

Here, examples of the method of adding iron (iron atoms) to the titanate compound particles include a method in which baking is performed in a state in which iron oxide or a water-soluble iron oxide compound (ferrous chloride, ferric chloride, ferrous sulfate, ferric sulfate, or the like) is added to a raw material. The liquid-phase method also includes a method in which a metatitanic acid (hydrate of titanium oxide) and other metal oxides or other metal carbonates are added to an aqueous solution of an anhydride or hydrate of a water-soluble iron oxide compound to be reacted therewith, and the reactant is baked.

The amount of the titanate compound particles to be externally added is not particularly limited, and may be, for example, from 0.1% by weight to 2.0% by weight and preferably from 0.4% by weight to 1.5% by weight, with respect to the toner particles.

When the amount of the titanate compound particles to be externally added is in the above range, image unevenness is easily suppressed.

Other External Additives

Examples of other external additives include inorganic particles other than titanate compound particles. Examples of other inorganic particles include $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, Cao particles, $K_2O$ particles, $Na_2O$ particles, $ZrO_2$ particles, $CaO.SiO_2$ particles, $K_2O—(TiO_2)_n$ particles, $Al_2O_3.2SiO_2$ particles, $CaCO_3$ particles, $MgCO_3$ particles, $BaSO_4$ particles, and $MgSO_4$ particles.

The surfaces of inorganic particles as other external additives may preferably be hydrophobized. For example, inorganic particles are dipped in a hydrophobizing agent so as to be hydrophobized. The hydrophobizing agent is not particularly limited, and examples thereof include a silane coupling agent, a silicone oil, a titanate coupling agent, and an aluminum coupling agent. These may be used singly or in combination of two or more kinds thereof.

In general, the amount of the hydrophobizing agent is, for example, from 1 part by weight to 10 parts by weight with respect to 100 parts by weight of the inorganic particles.

As other external additives, there are also exemplified resin particles (resin particles such as polystyrene particles, PMMA particles, and melamine resin particles) and a cleaning activator (e.g., particles of metal salt of higher fatty acid represented by zinc stearate and particles of fluorine high-molecular weight polymer).

The amount of other external additives to be externally added is, for example, preferably from 0.01% by weight to 5% by weight, and more preferably from 0.01% by weight to 2.0% by weight with respect to the toner particles.

Toner Manufacturing Method

Next, a method of manufacturing a toner according to this exemplary embodiment will be described.

The toner according to this exemplary embodiment is obtained by externally adding an external additive to toner particles after manufacturing of the toner particles.

The toner particles may be manufactured using any one of a dry manufacturing method (e.g., kneading and pulverization method) and a wet manufacturing method (e.g., aggregation and coalescence method, suspension and polymerization method, and dissolution and suspension method). The toner particle manufacturing method is not particularly limited to these manufacturing methods, and a known manufacturing method is employed.

Among these, the toner particles are preferably obtained by an aggregation and coalescence method.

Specifically, for example, when the toner particles are manufactured by an aggregation and coalescence method, the toner particles are manufactured through the steps of: preparing a resin particle dispersion in which resin particles as a binder resin are dispersed (resin particle dispersion preparation step); aggregating the resin particles (if necessary, other particles) in the resin particle dispersion (if necessary, in the dispersion after mixing with other particle dispersions) to form aggregated particles (aggregated particle forming step); and heating the aggregated particle dispersion in which the aggregated particles are dispersed, to coalesce the aggregated particles, thereby forming toner particles (coalescence step).

The toner particles may be manufactured through the steps of: further mixing, after the aggregated particle dispersion in which the aggregated particles are dispersed is obtained, the aggregated particle dispersion and the resin particle dispersion in which the resin particles are dispersed to conduct aggregation so that the resin particles are further adhered to the surfaces of the aggregated particles, thereby forming second aggregated particles; and coalescing the second aggregated particles by heating a second aggregated particle dispersion in which the second aggregated particles are dispersed, thereby forming toner particles having a core-shell structure.

The toner according to this exemplary embodiment is manufactured by, for example, adding an external additive to dry toner particles that have been obtained, and mixing them. The mixing may be performed with, for example, a V-blender, a Henschel mixer, a Loedige mixer, or the like. Furthermore, if necessary, coarse toner particles may be removed using a vibrating sieving machine, a wind power sieving machine, or the like.

Electrostatic Charge Image Developer

An electrostatic charge image developer according to this exemplary embodiment includes at least a toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coating carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluidized bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a contact charging-type charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, a cleaning unit having a cleaning blade that cleans the surface of the image holding member, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including the steps of: charging a surface of an image holding member by a contact charging-type charging unit; forming an electrostatic charge image on the charged surface of the image holding member; developing the electrostatic charge image formed on the surface of the image holding member with the electrostatic charge image developer according to this exemplary embodiment to form a toner image; transferring the toner image formed on the surface of the image holding member onto a surface of a recording medium; cleaning the surface of the image holding member by a cleaning blade; and fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; or an apparatus that is provided with an erasing unit that irradiates, after transfer of a toner image, a surface of an image holding member with erase light before charging for erasing.

In the case of an intermediate transfer-type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, the image forming apparatus is not limited thereto. Major parts shown in the drawing will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with four color toners, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration. Here, the first unit 10Y that is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 61 having a cleaning blade 6Y-1 that removes the toner remaining on the surface of the photoreceptor 1Y after primary transfer, are arranged in sequence.

The primary transfer roll 5Y is disposed inside the intermediate transfer belt 20 so as to be provided at a position opposed to the photoreceptor 1Y. Furthermore, bias supplies (not shown) that apply a primary transfer bias are connected to the primary transfer rolls 5Y, 5M, 5C, and 5K, respectively.

Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^6$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying the laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image that is formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner is electrostatically adhered to an erased latent image part on the surface of the photoreceptor 1Y, whereby the latent image is developed with the yellow toner. Next, the photoreceptor 1Y having the yellow toner image formed thereon travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y, an electrostatic force toward the primary transfer roll 5Y from the photoreceptor 1Y acts on the toner image, and the toner image on the photoreceptor 1Y is transferred onto the intermediate transfer belt 20. The transfer bias applied at this time has the opposite polarity (+) of the toner polarity (−), and is controlled to +10 μA in the first unit 10Y by the controller (not shown).

On the other hand, the toner remaining on the photoreceptor 1Y is removed and recovered by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like, and as a recording medium, an OHP sheet and the like are also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge and Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
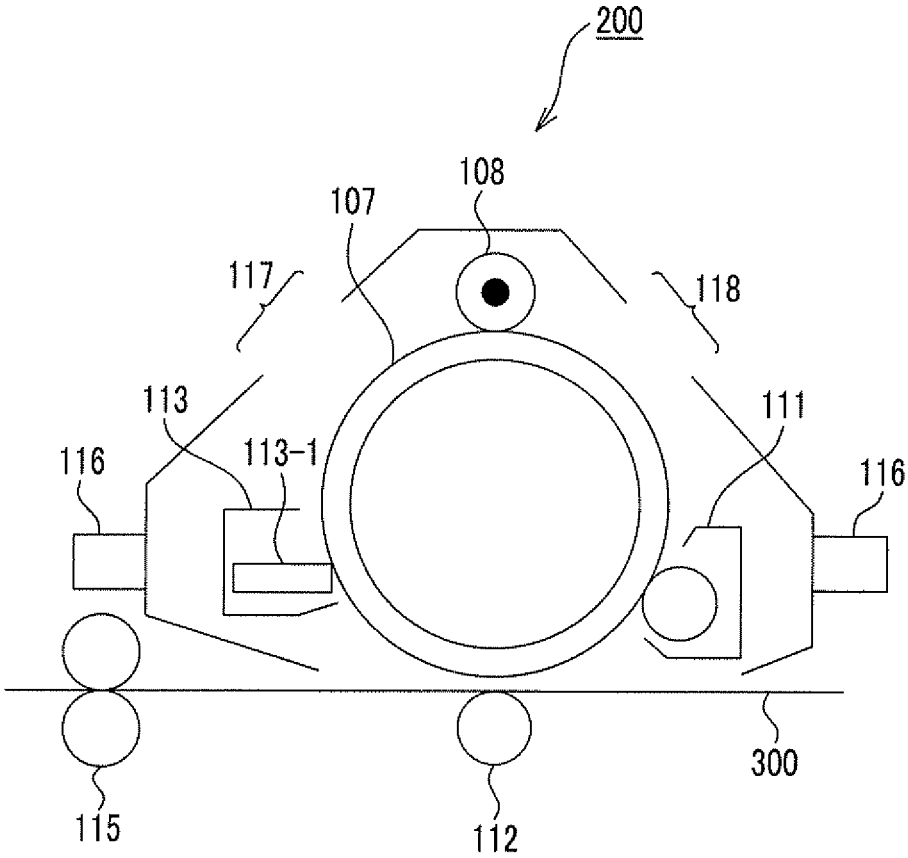
FIG. 2 is a schematic diagram showing a configuration of an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit) provided around the photoreceptor 107, a developing device 111 (an example of the developing unit), and a photoreceptor cleaning device 113 (an example of the cleaning unit) having a cleaning blade 113-1 are integrally combined and held by, for example, a casing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment is a toner cartridge that accommodates the toner according to this exemplary embodiment and is detachable from an image forming apparatus. The toner cartridge accommodates a toner for replenishment for being supplied to the developing unit provided in the image forming apparatus.

The image forming apparatus shown in FIG. 1 has a configuration in which the toner cartridges 8Y, 8M, 8C, and 8K are detachable therefrom, and the developing devices 4Y, 4M, 4C, and 4K are connected to the toner cartridges corresponding to the respective developing devices (colors) with toner supply tubes (not shown), respectively. In addition, when the toner accommodated in the toner cartridge runs low, the toner cartridge is replaced.

EXAMPLES

Hereinafter, this exemplary embodiment will be described more specifically and in more detail using examples and comparative examples, but is not limited to these examples. Unless specifically noted, "parts" means "parts by weight".

Preparation of Toner Particles

Toner Particles 1

Preparation of Polyester Resin Particle Dispersion

Ethylene Glycol (manufactured by Wako Pure Chemical Industries, Ltd.): 37 parts

Neopentyl Glycol (manufactured by Wako Pure Chemical Industries, Ltd.): 65 parts 1,9-Nonanediol (manufactured by Wako Pure Chemical Industries, Ltd.): 32 parts Terephthalic Acid (manufactured by Wako Pure Chemical Industries, Ltd.): 96 parts The above monomers are charged into a flask, and the temperature is increased to 200° C. over 1 hour. After confirming that stirring is performed in the reaction system, 1.2 parts of dibutyltin oxide is put thereinto. Furthermore, while removing generated water by distillation, the temperature is increased from 200° C. to 240° C. over 6 hours to further continue the dehydration condensation reaction for 4 hours at 240° C., thereby obtaining a polyester resin A having an acid value of 9.4 mgKOH/g, a weight average molecular weight of 13,000, and a glass transition temperature of 62° C.

Next, while being in a molten state, the polyester resin A is transferred to a Cavitron CD1010 (manufactured by Eurotec, Ltd.) at a rate of 100 parts/min. Diluted ammonia water having a concentration of 0.37% that is obtained by diluting reagent ammonia water with ion exchange water is put into a separately provided aqueous medium tank, and transferred to the Cavitron together with the polyester resin melt at a rate of 0.1 L/min while being heated to 120° C. with a heat exchanger. The Cavitron is operated under conditions of a rotor rotation speed of 60 Hz and a pressure of 5 kg/cm$^2$, thereby obtaining a polyester resin particle dispersion in which resin particles having a volume average particle diameter of 160 nm, a solid content of 30%, a glass transition temperature of 62° C., and a weight average molecular weight Mw of 13,000 are dispersed.

Preparation of Colorant Particle Dispersion

Cyan Pigment (Pigment Blue 15:3, manufactured by Dainichiseika Color & Chemicals Mfg. Co., Ltd.): 10 parts Anionic Surfactant (Neogen SC, manufactured by Dai-Ichi Kogyo Seiyaku Co., Ltd.): 2 parts Ion Exchange Water: 80 parts The above components are mixed with each other and dispersed for 1 hour using a high-pressure impact-type disperser Ultimizer (HJP30006, manufactured by Sugino Machine, Ltd.), thereby obtaining a colorant particle dispersion having a volume average particle diameter of 180 nm and a solid content of 20%.

Preparation of Release Agent Particle Dispersion

Carnauba Wax (RC-160, melting temperature: 84° C., manufactured by Toakasei Co., Ltd.): 50 parts Anionic Surfactant (Neogen SC, manufactured by Dai-Ichi Kogyo Seiyaku Co., Ltd.): 2 parts Ion Exchange Water: 200 parts The above components are heated to 120° C. and mixed and dispersed by Ultra Turrax T50 manufactured by IKA-Werke GmbH & Co. KG. Then, a dispersion treatment is performed by a pressure discharge-type homogenizer, thereby obtaining a release agent particle dispersion having a volume average particle diameter of 200 nm and a solid content of 20%.

Preparation of Toner Particles

Polyester Resin Particle Dispersion: 200 parts

Colorant Particle Dispersion: 25 parts

Release Agent Particle Dispersion: 30 parts

Polyaluminum Chloride: 0.4 part

Ion Exchange Water: 100 parts

The above components are put into a stainless-steel flask, and mixed and dispersed using an Ultra Turrax manufactured by IKA-Werke GmbH & Co. KG. Then, while being stirred in an oil bath for heating, the flask is heated to 48° C. After holding for 30 minutes at 48° C., 70 parts of a polyester resin particle dispersion, that is the same as the above polyester resin particle dispersion, is added to the flask.

Thereafter, the pH in the system is adjusted to 8.0 using a sodium hydroxide aqueous solution having a concentration of 0.5 mol/L. Then, the stainless-steel flask is sealed and heated to 90° C. while being continuously stirred with a seal of a stirring shaft that is magnetically sealed, followed by holding for 3 hours. After the reaction ends, the obtained material is cooled at a rate of temperature decrease of 2° C./min, filtered, and washed with ion exchange water. Then, solid-liquid separation is performed through Nutsche-type suction filtration. The obtained material is further redispersed using 3 L of ion exchange water at 30° C., and stirred and washed at 300 rpm for 15 minutes. This washing operation is further repeated six times, and when the filtrate has a pH of 7.54 and an electrical conductivity of 6.5 μS/cm, solid-liquid separation is performed through Nutsche-type suction filtration using No. 5A filter paper. Next, vacuum drying is continued for 12 hours, thereby obtaining toner particles.

A result of measuring a volume average particle diameter D50v of the toner particles 1 by a Coulter counter is 5.8 μm and a SF1 is 130.

Preparation of External Additive

Titanate Compound Particles T1

Titanate compound particles T1 are prepared by the following method.

A 4.0 N sodium hydroxide aqueous solution is added to a metatitanic acid dispersion to adjust the pH to 9.0, and then a 6.0 N hydrochloric acid aqueous solution is added to adjust the pH to 5.5 to thereby conduct neutralization. Thereafter, to the metatitanic acid prepared by filtration and water washing, water is added to prepare a dispersion equivalent to 1.25 mol/L in terms of titanium oxide, and then a 6.0 N hydrochloric acid aqueous solution is added to adjust the pH to 1.2. Next, the temperature of the dispersion is adjusted to 35° C. and stirring is performed for 55 minutes.

A metatitanic acid equivalent to 0.156 mol in terms of titanium oxide is collected from the dispersion and put into a reaction container, and a strontium chloride ($SrCl_2$) aqueous solution and a ferric chloride aqueous solution are put into the reaction container. Next, water is added to the reaction container to adjust the concentration of the titanium oxide to 0.156 mol/L. Here, the strontium chloride ($SrCl_2$) is added to be 1.15 in a molar ratio with respect to the titanium oxide, and the ferric chloride is added to be 0.130 in a molar ratio with respect to the titanium oxide.

The atmosphere in the reaction container is replaced with nitrogen gas, and then the temperature is increased to 90° C. while stirring. A 4.0 N sodium hydroxide aqueous solution is added dropwise over 24 hours until the pH is adjusted to 8.0, and then stirring is performed for 1 hour at 90° C., and the reaction ends. After the reaction ends, the content is cooled to 40° C. and left, and the supernatant liquid is removed. Thereafter, decantation is repeated two times using 2500 parts by weight of pure water, and then a cake layer is formed on Nutsche by suction filtration, and washed by passing 3000 parts by weight of pure water through the cake layer. The water-washed cake layer is taken out as a solid substance and dried for 8 hours at 110° C., thereby obtaining a dried strontium titanate product.

The obtained, dried strontium titanate product is put into a crucible made of alumina, and baked at 930° C. After baking, the product is crushed for 60 minutes using a mechanical pulverizer to obtain titanate compound particles T1. The iron content of the obtained titanate compound particles T1 is 1250 ppm when being measured, and the volume average particle diameter is 0.3

Titanate Compound Particles T2, T3, T6, T7, and T8 Titanate compound particles T2, T3, T6, T7, and T8 are prepared in the same manner as in the case of the titanate compound particles T1, except that the amount of ferric chloride to be added is changed according to Table 1.

Titanate Compound Particles T4

Titanate compound particles T4 are prepared in the same manner as in the case of the titanate compound particles T1, except that calcium chloride ($CaCl_2$) is used in place of strontium chloride ($SrCl_2$) and the amount of ferric chloride to be added and a stirring time of the metatitanic acid dispersion at 35° C. are changed according to Table 1.

Titanate Compound Particles T5

Titanate compound particles T5 are prepared in the same manner as in the case of the titanate compound particles T1 except that magnesium chloride ($MgCl_2$) is used in place of strontium chloride ($SrCl_2$) and the amount of ferric chloride to be added and a stirring time of the metatitanic acid dispersion at 35° C. are changed according to Table 1.

Comparative Titanate Compound Particles CT1 and CT2

Titanate compound particles CT1 and CT2 are prepared in the same manner as in the case of the titanate compound particles T1, except that the amount of ferric chloride to be added is changed according to Table 1.

Comparative Titanate Compound Particles CT3: Corresponding to Composite Inorganic Fine Powder 6 in Japanese Patent No. 4979517

A titanyl sulfate powder is dissolved in distilled water and the solution to which the sulfuric acid and the distilled water are added is adjusted so that the concentration of Ti in the solution is 1.5 (mol/l) and the acid concentration at the time of the end of the reaction is 2.0 (mol/l). This solution is heated at 110° C. for 36 hours using an airtight container to conduct a hydrolysis reaction. Thereafter, water washing is performed to sufficiently remove the sulfuric acid and impurities, thereby obtaining a metatitanic acid slurry. To this slurry, strontium carbonate ($SrCO_3$: average particle diameter 80 nm) is added so that the molar amount thereof is the same as that of titanium oxide, and iron oxide ($Fe_2O_3$: average particle diameter 20 nm) is added so as to be 2% molar amount with respect to the titanium oxide. After sufficient mixing in a water wet state, washing and drying are performed, and then the obtained material is sintered for 7 hours at 750° C. and subjected to mechanical pulverization and classification steps, and thus titanate compound particles CT3 (strontium titanate particles) are obtained.

Comparative Titanate Compound Particles CT4: Corresponding to Titanate Compound of Example 1 in JP-A-2010-19887)

A metatitanic acid dispersion prepared using a sulfuric acid method is desulfurized by adjusting the pH to 9.0 with a 4.0 mol/L sodium hydroxide aqueous solution. Then, a 6.0 mol/L hydrochloric acid aqueous solution is added to adjust the pH to 5.5 to thereby conduct neutralization. Thereafter, water is added to a metatitanic acid cake prepared by filtering the metatitanic acid dispersion and by performing water washing, thereby preparing a dispersion equivalent to 1.25 mol/L in terms of titanium oxide ($TiO_2$). Then, the pH is adjusted to 1.2 with a 6.0 mol/L hydrochloric acid aqueous solution. The temperature of the dispersion is adjusted to 35° C. and stirring is performed for 1 hour at this temperature, thereby subjecting the metatitanic acid dispersion to peptization.

A metatitanic acid equivalent to 0.156 mol in terms of titanium oxide ($TiO_2$) is collected from the metatitanic acid dispersion subjected to the peptization and put into a reaction container. Next, a calcium carbonate ($CaCO_3$) aqueous solution and a ferric chloride aqueous solution are put into the reaction container. Thereafter, the reaction system is prepared so that the concentration of the titanium oxide is 0.156 mol/L. Here, the calcium carbonate ($CaCO_3$) is added to be 1.15 in a molar ratio with respect to the titanium oxide ($CaCO_3/TiO_2$=1.15/1.00), and the ferric chloride is added to be 0.03 in a molar ratio with respect to the titanium oxide ($FeCl_3/TiO_2$=0.03/1.00).

The inside of the reaction container is supplied with nitrogen gas and left for 20 minutes so that the inside of the reaction container is under the nitrogen gas atmosphere. Then, the mixed solution of the metatitanic acid, the calcium carbonate, and the ferric chloride is warmed to 90° C. Next, a sodium hydroxide aqueous solution is added over 24 hours until the pH is adjusted to 8.0, and then stirring is continued for 1 hour at 90° C. to end the reaction.

After the end of the reaction, the inside of the reaction container is cooled to 40° C., the supernatant liquid is removed under the nitrogen atmosphere, and then 2500 parts by weight of pure water is put into the reaction container to repeat decantation two times. After the decantation is conducted, the reaction system is filtered by Nutsche to form a cake, and the obtained cake is heated to 110° C. to be dried for 8 hours in the atmosphere.

The obtained, dried calcium titanate product is put into a crucible made of alumina, and dehydrated and baked at 930° C. After the baking, the calcium titanate is put into water and wet pulverization is performed using a sand grinder to obtain a dispersion. Then, a 6.0 mol/L hydrochloric acid aqueous solution is added to adjust the pH to 2.0, thereby removing excessive calcium carbonate. After the removal, the calcium titanate is subjected to wet-hydrophobizing using a silicone oil emulsion (dimethylpolysiloxane emulsion) "SM7036EX (manufactured by Toray Dow Corning Silicone Co., Ltd.)". In the hydrophobizing, 0.7 part by weight of the silicone oil emulsion is added to 100 parts by weight of the calcium titanate solid content, and stirring is performed for 30 minutes.

After the wet-hydrophobizing, a 4.0 mol/L sodium hydroxide aqueous solution is added to adjust the pH to 6.5 to thereby conduct neutralization. Then, filtration and washing are performed, and drying is performed at 150° C. Crushing is performed for 60 minutes using a mechanical pulverizer, thereby obtaining titanate compound particles CT4 (calcium titanate particles).

Preparation of Examples 1 to 12 and Comparative Examples 1 to 4

With a combination of toner particles and titanate compound particles described in Table 1, titanate compound particles (the number of parts is described in Table 1) and 3 parts of colloidal silica (manufactured by Aerosil Nippon Co., Ltd., R972) are added with respect to 100 parts of toner particles and mixed using a Henschel mixer, thereby obtaining each toner.

Each obtained toner and a carrier are put into a V-blender at a ratio of 5:95 (toner:carrier) (mass ratio) and stirred for 20 minutes to obtain each developer.

As the carrier, a carrier prepared as follows is used.

Ferrite Particles (volume average particle diameter: 50 μm): 100 parts

Toluene: 14 parts

Styrene-Methyl Methacrylate Copolymer (component ratio: 90/10, Mw: 80000): 2 parts Carbon Black (R330, manufactured by Cabot Corporation): 0.2 part First, the above components, excluding the ferrite particles, are stirred for 10 minutes by a stirrer and dispersed to prepare a coating liquid. Next, the coating liquid and the ferrite particles are put into a vacuum degassing-type kneader and stirred for 30 minutes at 60° C., and then degassed and dried by reducing the pressure while performing heating, thereby obtaining a carrier.

Evaluations

The developer obtained in each example is subjected to the following evaluations.

Filming Evaluation

Using the developer obtained in each example, output is continuously performed on 5000 pieces of paper using a modified image forming apparatus "DocuPrint C3200" (having a processing speed of 320 mm/s and modified so that a fixing device is removed therefrom, whereby the modified apparatus is operated in the same manner as usual until the transfer step), manufactured by Fuji Xerox Co., Ltd., under the environment of 10° C./15% RH and a toner amount on a recording medium of 0.2 g/m$^2$. The number of prints on which image defect is caused by filming to the photoreceptor is expressed in percentage and evaluated.

The evaluation standards are as follows.

G1: The frequency of occurrence of image defect by filming is less than 0.5%.

G2: The frequency of occurrence of image defect by filming is from 0.5% to less than 1.0%.

G3: The frequency of occurrence of image defect by filming is from 1.0% to less than 2.0%.

G4: The frequency of occurrence of image defect by filming is from 2.0% to less than 5.0%.

G5: The frequency of occurrence of image defect by filming is 5.0% or greater.

Image Unevenness Evaluation

A developing machine of an image forming apparatus "DocuCentre 500CP", manufactured by Fuji Xerox Co., Ltd., is filled with the developer obtained in each example.

A solid image that has an image density of 90% in which a non-image part is partially included is continuously output on 1000 pieces of A4 paper using this image forming apparatus under the environment of 10° C. and 15% RH. Thereafter, a halftone image having an image density of 50% is output on a piece of A4 paper. In the output halftone image, the image density is measured at 12 points in a part corresponding to the non-image part of the solid image in which the non-image part is partially included, and a part corresponding to the solid image part, respectively, using a densitometer X-rite (X-rite 404, manufactured by X-rite), and an average value thereof is taken to calculate a difference in image density between the part corresponding to the non-image part and the part corresponding to the solid image part and the image unevenness is evaluated. The acceptable range is from G1 to G4.

The evaluation standards are as follows.

G1: The difference in image density is less than 0.01%.

G2: The difference in image density is from 0.01% to less than 0.1%.

G3: The difference in image density is from 0.1% to less than 0.3%.

G4: The difference in image density is from 0.3% to less than 0.5%.

G5: The difference in image density is 0.5% or greater.

Hereinafter, the evaluation results are shown in Tables 1 and 2, together with detailed information of the examples.

TABLE 1

| | Titanate Compound Particle Preparation Conditions | | Physical Properties of Titanate Compound Particle | | |
|---|---|---|---|---|---|
| | Iron Compound | | | | |
| Titanate Compound Particles | Type/Amount to be Added (molar ratio with respect to titanium oxide) | Stirring Time of Metatitanic Acid Dispersion at 35° C. | Substance | Iron Content | Volume Average Particle Diameter |
| T1 | Ferric Chloride/0.130 | 55 minutes | Strontium Titanate | 1250 ppm | 0.3 μm |
| T2 | Ferric Chloride/0.570 | 55 minutes | Strontium Titanate | 5500 ppm | 0.3 μm |

TABLE 1-continued

| Titanate Compound Particles | Titanate Compound Particle Preparation Conditions: Iron Compound Type/Amount to be Added (molar ratio with respect to titanium oxide) | Stirring Time of Metatitanic Acid Dispersion at 35° C. | Physical Properties of Titanate Compound Particle: Substance | Iron Content | Volume Average Particle Diameter |
|---|---|---|---|---|---|
| T3 | Ferric Chloride/0.127 | 55 minutes | Strontium Titanate | 1220 ppm | 0.3 μm |
| T4 | Ferric Chloride/0.096 | 50 minutes | Calcium Titanate | 1250 ppm | 0.4 μm |
| T5 | Ferric Chloride/0.085 | 60 minutes | Magnesium Titanate | 1250 ppm | 0.2 μm |
| T6 | Ferric Chloride/0.260 | 55 minutes | Strontium Titanate | 2500 ppm | 0.3 μm |
| T7 | Ferric Chloride/0.395 | 55 minutes | Strontium Titanate | 3800 ppm | 0.3 μm |
| T8 | Ferric Chloride/0.510 | 55 minutes | Strontium Titanate | 4900 ppm | 0.3 μm |
| CT1 | Ferric Chloride/0.680 | 55 minutes | Strontium Titanate | 6500 ppm | 0.3 μm |
| CT2 | Ferric Chloride/0.104 | 55 minutes | Strontium Titanate | 1000 ppm | 0.3 μm |
| CT3 | | | Strontium Titanate | 6100 ppm | 0.3 μm |
| CT4 | | | Calcium Titanate | 800 ppm | 0.3 μm |

TABLE 2

| | Developer: Toner Particles | Titanate Compound Particles: Type | Substance | Iron Content | Number of Parts of Amount to be Externally Added % by weight (with respect to toner particles) | Evaluation: Filming | Image Unevenness |
|---|---|---|---|---|---|---|---|
| Example 1 | 1 | T1 | Strontium Titanate | 1250 ppm | 1.0 part/1.0% by weight | G1 | G1 |
| Example 2 | 1 | T2 | Strontium Titanate | 5500 ppm | 1.0 part/1.0% by weight | G1 | G2 |
| Example 3 | 1 | T3 | Strontium Titanate | 1220 ppm | 1.0 part/1.0% by weight | G1 | G2 |
| Example 4 | 1 | T1 | Strontium Titanate | 1250 ppm | 0.3 part/0.3% by weight | G2 | G3 |
| Example 5 | 1 | T1 | Strontium Titanate | 1250 ppm | 1.8 parts/1.8% by weight | G1 | G4 |
| Example 6 | 1 | T4 | Calcium Titanate | 1250 ppm | 1.0 part/1.0% by weight | G1 | G2 |
| Example 7 | 1 | T5 | Magnesium Titanate | 1250 ppm | 1.0 part/1.0% by weight | G1 | G2 |
| Example 8 | 1 | T6 | Strontium Titanate | 2500 ppm | 1.0 part/1.0% by weight | G1 | G1 |
| Example 9 | 1 | T7 | Strontium Titanate | 3800 ppm | 1.0 part/1.0% by weight | G1 | G1 |
| Example 10 | 1 | T8 | Strontium Titanate | 4900 ppm | 1.0 part/1.0% by weight | G1 | G2 |
| Example 11 | 1 | T1 | Strontium Titanate | 1250 ppm | 0.4 part/0.4% by weight | G1 | G1 |
| Example 12 | 1 | T1 | Strontium Titanate | 1250 ppm | 1.5 parts/1.5% by weight | G1 | G1 |
| Comparative Example 1 | 1 | CT1 | Strontium Titanate | 6500 ppm | 1.0 part/1.0% by weight | G1 | G5 |
| Comparative Example 2 | 1 | CT2 | Strontium Titanate | 1000 ppm | 1.0 part/1.0% by weight | G1 | G5 |
| Comparative Example 3 | 1 | CT3 | Strontium Titanate | 6100 ppm | 1.0 part/1.0% by weight | G1 | G5 |
| Comparative Example 4 | 1 | CT4 | Calcium Titanate | 800 ppm | 1.0 part/1.0% by weight | G1 | G5 |

From the above results, it is found that as compared with the comparative examples, favorable results are obtained in the filming evaluation and the image unevenness evaluation in the examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and an external additive containing titanate compound particles having an iron content of from greater than 1200 ppm to 6000 ppm.

2. The electrostatic charge image developing toner according to claim 1, wherein the iron content of the titanate compound particles is from 1240 ppm to 5000 ppm.

3. The electrostatic charge image developing toner according to claim 2, wherein an amount of the titanate compound particles to be externally added is from 0.4% by weight to 1.5% by weight with respect to the toner particles.

4. The electrostatic charge image developing toner according to claim 2, wherein the titanate compound particles are at least one type selected from strontium titanate particles, calcium titanate particles, and magnesium titanate particles.

5. The electrostatic charge image developing toner according to claim 1, wherein the iron content of the titanate compound particles is from 1250 ppm to 4000 ppm.

6. The electrostatic charge image developing toner according to claim 5, wherein an amount of the titanate compound particles to be externally added is from 0.4% by weight to 1.5% by weight with respect to the toner particles.

7. The electrostatic charge image developing toner according to claim 6, wherein the titanate compound particles are at least one type selected from strontium titanate particles, calcium titanate particles, and magnesium titanate particles.

8. The electrostatic charge image developing toner according to claim 5, wherein the titanate compound particles are at least one type selected from strontium titanate particles, calcium titanate particles, and magnesium titanate particles.

9. The electrostatic charge image developing toner according to claim 1, wherein an amount of the titanate compound particles to be externally added is from 0.1% by weight to 2.0% by weight with respect to the toner particles.

10. The electrostatic charge image developing toner according to claim 9 wherein the titanate compound particles are at least one type selected from strontium titanate particles, calcium titanate particles, and magnesium titanate particles.

11. The electrostatic charge image developing toner according to claim 1, wherein an amount of the titanate compound particles to be externally added is from 0.4% by weight to 1.5% by weight with respect to the toner particles.

12. The electrostatic charge image developing toner according to claim 11, wherein the titanate compound particles are at least one type selected from strontium titanate particles, calcium titanate particles, and magnesium titanate particles.

13. The electrostatic charge image developing toner according to claim 1, wherein the titanate compound particles are at least one type selected from strontium titanate particles, calcium titanate particles, magnesium titanate particles, barium titanate particles, and zinc titanate particles.

14. The electrostatic charge image developing toner according to claim 1, wherein the titanate compound particles are at least one type selected from strontium titanate particles, calcium titanate particles, and magnesium titanate particles.

15. The electrostatic charge image developing toner according to claim 1, wherein the titanate compound particles have a volume average particle diameter of from 0.1 μm to 3.0 μm.

16. The electrostatic charge image developing toner according to claim 1, wherein the titanate compound particles have a volume average particle diameter of from 0.3 μm to 2.0 μm.

17. An electrostatic charge image developer comprising:

the electrostatic charge image developing toner according to claim 1.

18. A process cartridge that is detachable from an image forming apparatus, comprising:

a developing unit that accommodates the electrostatic charge image developer according to claim 17, and develops an electrostatic charge image formed on a surface of an image holding member with the electrostatic charge image developer to form a toner image.

19. An image forming apparatus comprising:

an image holding member;

a contact charging-type charging unit that charges a surface of the image holding member;

an electrostatic charge image forming unit that forms an electrostatic charge image on a charged surface of the image holding member;

a developing unit that contains the electrostatic charge image developer according to claim 17 and develops the electrostatic charge image formed on the surface of the image holding member with the electrostatic charge image developer to form a toner image;

a transfer unit that transfers the toner image formed on the surface of the image holding member onto a surface of a recording medium;

a cleaning unit having a cleaning blade that cleans the surface of the image holding member; and a fixing unit that fixes the toner image transferred onto the surface of the recording medium.

20. A toner cartridge that accommodates the electrostatic charge image developing toner according to claim 1 and is detachable from an image forming apparatus.

* * * * *